US005980072A

United States Patent [19]

Zirkle

[11] Patent Number: 5,980,072

[45] Date of Patent: Nov. 9, 1999

[54] CONVERSION KIT FOR BOAT RUNNING LIGHTS

[76] Inventor: Charles B. Zirkle, Rt.6 Box 26-1, Buckhannon, W. Va. 26201

[21] Appl. No.: 08/903,597

[22] Filed: Jul. 31, 1997

[51] Int. Cl.[6] ..... B63B 45/00

[52] U.S. Cl. ..... 362/477; 362/226; 362/363

[58] Field of Search ..... 439/616, 641; 362/226, 477, 363, 414

[56] References Cited

U.S. PATENT DOCUMENTS 1,522,204 1/1925 O'Neil ..... 439/641 X 4,856,452 8/1989 Pingel et al. ..... 362/477 X 5,704,704 1/1998 Reichard et al. ..... 362/477

*Primary Examiner*—Stephen Husar

[57] ABSTRACT

A conversion kit for boat running lights for converting a running light into a lantern for illuminating a boat's deck includes a conversion base portion coupling with an existing socket of a boat's running light. A conversion adapter portion is provided having electrical contacts with the conversion adapter portion being receivable through the conversion base and into the existing socket of the running light such that the electrical contacts of the adapter portion operationally connect with the contacts of the existing socket. The adapter has an upper socket portion extending upwardly therefrom for receiving a light bulb therein.

6 Claims, 2 Drawing Sheets

CONVERSION KIT FOR BOAT RUNNING LIGHTS

BACKGROUND OF THE INVENTION

1. Field of the Invention

The present invention relates to boat lights and more particularly pertains to a new conversion kit for boat running lights for converting a running light into a lantern for illuminating a boat's deck.

2. Description of the Prior Art

The use of boat lights is known in the prior art. More specifically, boat lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art boat lights include U.S. Pat. No. 5,394,315 to Ahroni; U.S. Pat. No. 5,339,225 to Wiggerman; U.S. Pat. No. Des. 355,864 to Lantz; U.S. Pat. No. 5,272,603 to Camarota et al.; U.S. Pat. No. 3,900,725 to Komon; and U.S. Pat. No. 4,856,452 to Pingel et al.

While these devices fulfill their respective, particular objectives and requirements, the aforementioned patents do not disclose a new conversion kit for boat running lights. The inventive device includes a conversion base portion coupling with an existing socket of a boat's running light. A conversion adapter portion is provided having electrical contacts and is receivable through the conversion base and into the existing socket of the running light with the electrical contacts communicating with contacts of the existing socket. The adapter has an upper socket portion extending upwardly therefrom for receiving a standard light bulb therein.

In these respects, the conversion kit for boat running lights according to the present invention substantially departs from the conventional concepts and designs of the prior art, and in so doing provides an apparatus primarily developed for the purpose of converting a running light into a lantern for illuminating a boat's deck.

SUMMARY OF THE INVENTION

In view of the foregoing disadvantages inherent in the known types of boat lights now present in the prior art, the present invention provides a new conversion kit for boat running lights construction wherein the same can be utilized for converting a running light into a lantern for illuminating a boat's deck.

The general purpose of the present invention, which will be described subsequently in greater detail, is to provide a new conversion kit for boat running lights apparatus and method which has many of the advantages of the boat lights mentioned heretofore and many novel features that result in a new conversion kit for boat running lights which is not anticipated, rendered obvious, suggested, or even implied by any of the prior art boat lights, either alone or in any combination thereof.

To attain this, the present invention generally comprises a conversion base portion having a hollow frustoconical central portion. The central portion has a narrow lower end and a wide upper end. The narrow lower end has a lower threaded circular flange extending downwardly therefrom. The lower threaded circular flange couples with an existing socket of a boat's running light. The wide upper end has an upper threaded circular flange extending upwardly therefrom. A conversion adapter portion is provided having a lower portion. The lower portion has a pair of diametrically opposed protrusions extending outwardly therefrom. The lower portion has a pair of electrical contacts disposed thereon. The lower portion is receivable through the conversion base and into the existing socket of the running light with the electrical contacts communicating with contacts of the existing socket. The adapter has an upper socket portion extending upwardly therefrom for receiving a standard light bulb therein. A clear cover is provided having an internally threaded open lower end and a rounded closed upper end. The internally threaded open lower end couples with the upper threaded circular flange of the conversion base portion and receiving the standard light bulb therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new conversion kit for boat running lights apparatus and method which has many of the advantages of the boat lights mentioned heretofore and many novel features that result in a new conversion kit for boat running lights which is not anticipated, rendered obvious, suggested, or even implied by any of the prior art boat lights, either alone or in any combination thereof.

It is another object of the present invention to provide a new conversion kit for boat running lights which may be easily and efficiently manufactured and marketed.

It is a further object of the present invention to provide a new conversion kit for boat running lights which is of a durable and reliable construction.

An even further object of the present invention is to provide a new conversion kit for boat running lights which is susceptible of a low cost of manufacture with regard to both materials and labor, and which accordingly is then susceptible of low prices of sale to the consuming public, thereby making such conversion kit for boat running lights economically available to the buying public.

Still yet another object of the present invention is to provide a new conversion kit for boat running lights which provides in the apparatuses and methods of the prior art some of the advantages thereof, while simultaneously overcoming some of the disadvantages normally associated therewith.

Still another object of the present invention is to provide a new conversion kit for boat running lights for converting a running light into a lantern for illuminating a boat's deck.

Yet another object of the present invention is to provide a new conversion kit for boat running lights which includes a conversion base portion coupling with an existing socket of a boat's running light. A conversion adapter portion is provided having electrical contacts and is receivable through the conversion base and into the existing socket of the running light with the electrical contacts communicating with contacts of the existing socket. The adapter has an upper socket portion extending upwardly therefrom for receiving a standard light bulb therein.

Still yet another object of the present invention is to provide a new conversion kit for boat running lights that eliminates the need to take a lantern on a boat for night fishing.

Even still another object of the present invention is to provide a new conversion kit for boat running lights that will provide an illuminating light that will be powered by the boats battery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
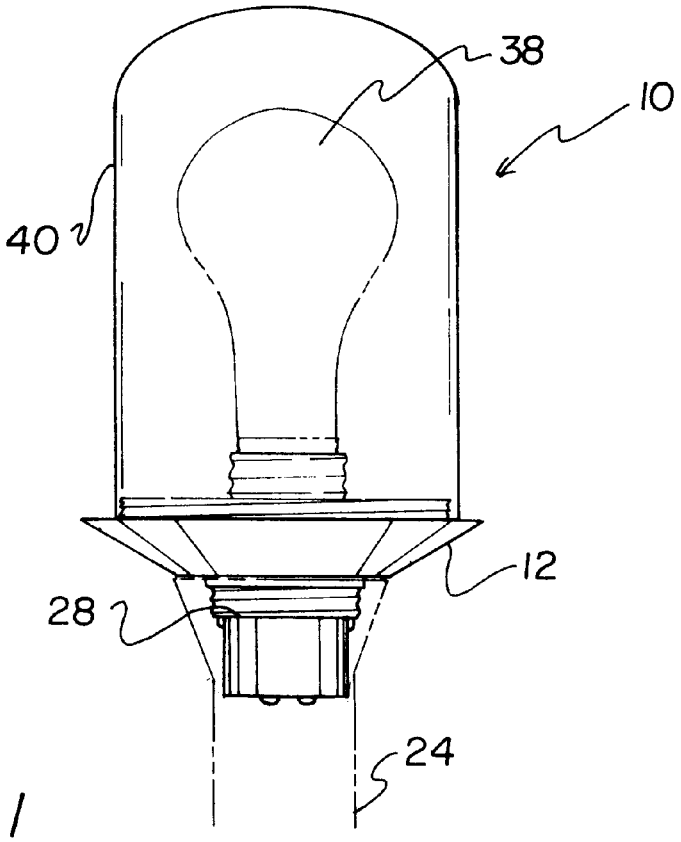
FIG. 1 is a front view of a new conversion kit for boat running lights according to the present invention.
Figure 3:
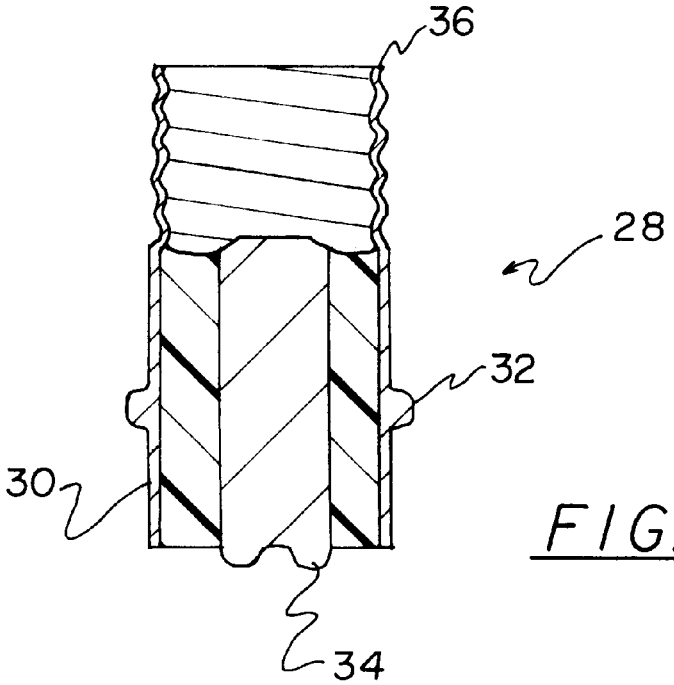
FIG. 3 is an exploded front view of the present invention.
Figure 2:
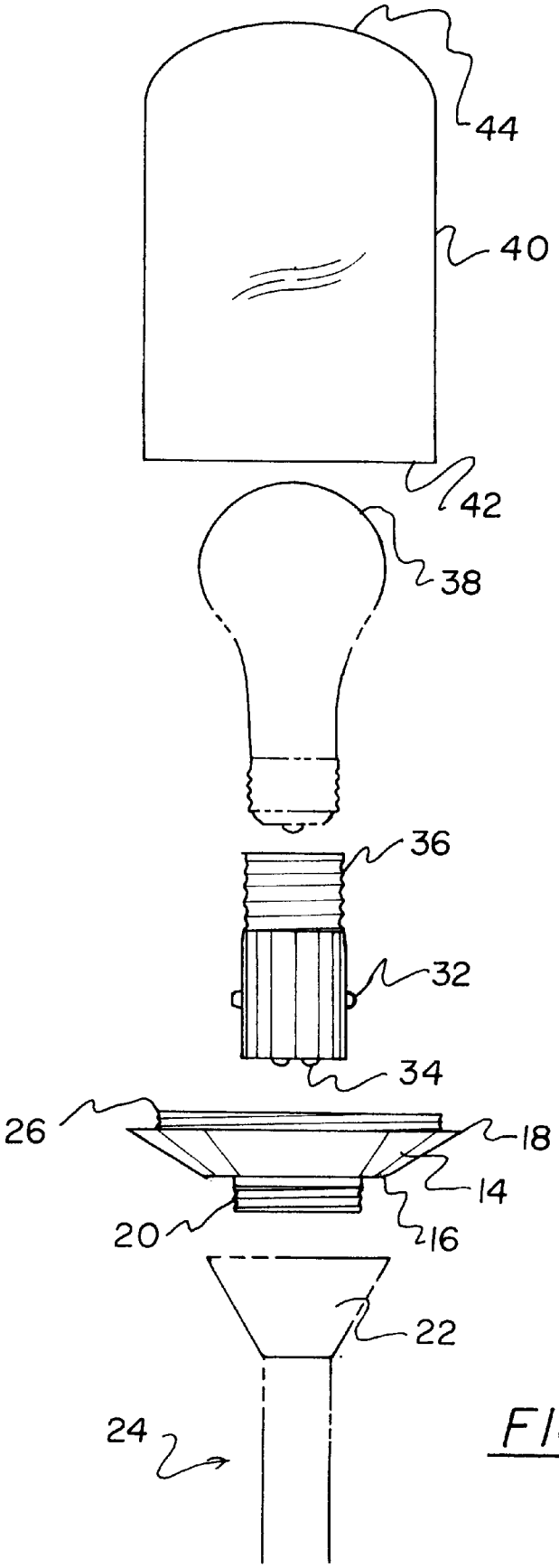
FIG. 2 is a cross-sectional view of the conversion adapter of the present invention.

With reference now to the drawings, and in particular to FIGS. 1 through 3 thereof, a new conversion kit for boat running lights embodying the principles and concepts of the present invention and generally designated by the reference numeral 10 will be described.

As best illustrated in FIGS. 1 through 3, the conversion kit for boat running lights 10 comprises a conversion base portion 12 having a hollow frustoconical central portion 14. The central portion 14 has a narrow lower end 16 and a wide upper end 18. The narrow lower end 16 has a lower threaded circular flange 20 extending downwardly therefrom. The lower threaded circular flange 20 couples with an existing socket 22 of a boat's running light 24. The wide upper end 18 has an upper threaded circular flange 26 extending upwardly therefrom.

A conversion adapter portion 28 is provided having a lower portion 30. The lower portion 30 has a pair of diametrically opposed protrusions 32 extending outwardly therefrom. The lower portion 30 has a pair of electrical contacts 34 disposed thereon. The lower portion 30 is receivable through the conversion base 12 and into the existing socket 22 of the running light 24 with the electrical contacts 34 communicating with contacts of the existing socket 22. (Not shown) The adapter 28 has an upper socket portion 36 extending upwardly therefrom for receiving a standard size incandescent edison light bulb 38 therein as shown in FIG. 2 of the drawings.

A clear cover 40 is provided having an internally threaded open lower end 42 and a rounded closed upper end 44. The internally threaded open lower end 42 couples with the upper threaded circular flange 26 of the conversion base portion 12 and receiving the standard light bulb 38 therein.

In use, a boat owner would simply remove the bulb from the running light 24 on his boat and install the present invention. The conversion base 12 is positioned atop the socket 22 of the running light 24 with the lower circular flange 20 received within the socket 22. The conversion adapter 28 is then positioned through the conversion base 12 with the lower portion 30 extending within the socket 22 of the running light 24. The electrical contacts 34 of the lower portion 30 will be in contact with the electrical contacts of the running light 24 to thereby transmit the electrical power received by the running light 24 from the boat's battery to the conversion adapter 28. A standard light bulb 38 is then positioned within the upper socket portion 36 of the adapter. The clear cover 40 is then positioned over the light bulb 38 and attached to the conversion base 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A conversion kit for boat running lights for converting a running light into a lantern for illuminating a boat's deck comprising, in combination:

a conversion base portion having a hollow frustoconical central portion, the central portion having a narrow lower end and a wide upper end, the narrow lower end having a lower threaded circular flange extending downwardly therefrom, the lower threaded circular flange coupling with an existing socket of a boat's running light, the wide upper end having an upper threaded circular flange extending upwardly therefrom;

a conversion adapter portion having a lower portion, the lower portion having a pair of diametrically opposed protrusions extending outwardly therefrom, the lower portion having a pair of electrical contacts disposed thereon, the lower portion receivable through the conversion base and into the existing socket of the running light with the electrical contacts of the lower portion of the conversion adapter being adapted to operationally connect with contacts of the existing socket, the adapter having an upper socket portion extending upwardly therefrom for receiving a light bulb therein; and a clear cover having an internally threaded open lower end and a rounded closed upper end, the internally threaded open lower end coupling with the upper threaded circular flange of the conversion base portion and receiving the standard light bulb therein.

2. A conversion kit for boat running lights for converting a running light into a lantern for illuminating a boat's deck comprising, in combination:

a conversion base portion coupling with an existing socket of a boat's running light;

a conversion adapter portion having electrical contacts and receivable through the conversion base and into the existing socket of the running light with the electrical contacts of the lower portion of the conversion adapter being adapted to operationally connect with contacts of the existino socket, the adapter having an upper socket portion extending upwardly therefrom for receiving a light bulb therein; and wherein the conversion base portion has a hollow frustoconical central portion, the central portion has a narrow lower end and a wide upper end, the narrow lower end has a lower threaded circular flange extending downwardly therefrom, the lower threaded circular flange coupling with the existing socket of a boat's running light, the wide upper end has an upper threaded circular flange extending upwardly therefrom.

3. The conversion kit for boat running lights as set forth in claim 2 and further including a clear cover coupling with the conversion base portion and receiving the light bulb therein.

4. The conversion kit for boat running lights as set forth in claim 2 wherein the conversion adapter portion has a lower portion, the lower portion has a pair of diametrically opposed protrusions extending outwardly therefrom, the lower portion has the pair of electrical contacts disposed thereon, the lower portion is receivable through the conversion base and into the existing socket of the running light.

5. The conversion kit for boat running lights as set forth in claim 4 and further including a clear cover with an internally threaded open lower end and a rounded closed upper end, the internally threaded open lower end coupling with the upper threaded circular flange of the conversion base portion and receiving the light bulb therein.

6. A device for converting a running light of a boat into a lantern for illuminating a boat's deck, the device comprising:

a conversion adapter having a lower plug portion and an upper socket portion, the lower plug portion having a substantially cylindrical shape and a pair of diametrically opposed protrusions extending outwardly from the lower plug portion for extending into the grooves of a boat running light socket, the lower plug portion having a substantially flat end face with a pair of electrical contacts disposed thereon, the electrical contacts comprising hemispherical protrusions from the end face and being spaced from each other from a center point on the end face, the lower plug portion being thereby adapted for insertion into the socket of the running light with the electrical contacts in communication with contacts of the socket, the upper socket portion extending upwardly from the lower plug portion and having a internally threaded cavity adapted for receiving the base of a standard light bulb.

* * * * *